United States Patent [19]

Wiand

[11] Patent Number: 4,867,701

[45] Date of Patent: Sep. 19, 1989

[54] ELECTRICAL OUTLET STRIP

[76] Inventor: Richard K. Wiand, 2870 Pine Lake Rd., Orchard Lake, Mich. 48033

[21] Appl. No.: 229,837

[22] Filed: Aug. 8, 1988

[51] Int. Cl.[4] ..... H01R 13/73; H01R 25/16

[52] U.S. Cl. ..... 439/501; 439/502; 439/527; 439/652; 248/205.3

[58] Field of Search ..... 439/211, 212, 214, 650–654, 439/502, 505, 527, 532, 533, 538, 571; 174/70 C; 248/68.1, 74.2, 205.3, 316.7

[56] References Cited

U.S. PATENT DOCUMENTS

| | | | |
|---|---|---|---|
| 2,219,568 | 10/1940 | Stewart . | |
| 2,714,713 | 8/1955 | Parajon . | |
| 3,049,688 | 8/1962 | Sinopoli . | |
| 3,082,397 | 3/1963 | Clarkson et al. . | |
| 3,439,315 | 4/1969 | Hamel et al. . | |
| 4,017,137 | 4/1977 | Parks . | |
| 4,133,349 | 9/1978 | Instone . | |
| 4,386,813 | 6/1983 | Griffin . | |
| 4,705,342 | 11/1987 | Schwartz | 439/650 |

FOREIGN PATENT DOCUMENTS

| | | | |
|---|---|---|---|
| 982672 | 1/1976 | Canada | 439/527 |
| 2554619 | 6/1976 | Fed. Rep. of Germany | 439/652 |
| 3243727 | 5/1984 | Fed. Rep. of Germany | 439/651 |
| 968911 | 12/1950 | France | 439/650 |
| 310777 | 5/1969 | Switzerland | 248/68.1 |
| 1042844 | 9/1966 | United Kingdom | 439/571 |

OTHER PUBLICATIONS

Washington Post ad., Thurs., Nov. 30, 1986.

*Primary Examiner*—Gary F. Paumen

*Attorney, Agent, or Firm*—Harness, Dickey & Pierce

[57] ABSTRACT

An electrical outlet strip with a serially-arranged plurality of outlets has a terminal outlet spaced a distance sufficient from its adjacent outlet to receive an oversized plug or adapter without interfering with the receipt of a standard-sized pronged plug by the adjacent outlet. The internal wiring of the outlet strip of the invention includes a circuit breaker built directly into the housing of the outlet strip. The electrical outlet strip of the present invention is further provided with an outlet strip cradle for removably mounting the outlet strip to a surface.

16 Claims, 2 Drawing Sheets

ELECTRICAL OUTLET STRIP

BACKGROUND OF THE INVENTION

The present invention relates generally to electrical outlet strips and, more particularly, to an electrical outlet strip which can receive an oversized plug or adapter in one of its outlets without interfering with the use of the remaining outlets of the strip.

Electrical outlet strips provide a major convenience by increasing the number of outlets available in a minimum of space. However, when a pronged plug or adapter having a large body is received by one of the outlets of a conventional outlet strip, the oversized plug or adapter generally precludes the use of the adjacent outlet in the strip.

Most conventional electrical outlets strips include an independently housed circuit breaker unit which is placed and wired into the housing of the outlet strip during its assembly. The use of such circuit breaker units, however, is disadvantageous in that it first requires the assembly of the unit into its housing and then a second, additional assembly of the housing into the outlet strip at an increased cost.

The housings of some conventional outlet strips are also provided with keyhole apertures in the back of the housing to provide means for attaching the strip to a surface with screws or nails. However, this method of attachment makes it difficult to attach and remove the outlet strip and is disfiguring to the surface to which the strip is attached.

Thus, it would be desirable to provide an electrical outlet strip which can receive an oversized pronged plug or adapter without sacrificing the use of any of the remaining outlets. It would also be desirable to provide an outlet strip with a built-in circuit breaker. It would further be desirable to provide an electrical outlet strip with improved means for removably mounting the strip to a surface.

SUMMARY OF THE INVENTION

The present invention provides an electrical outlet strip generally comprising a serially-arranged plurality of outlets within an elongated housing. The terminal outlet of the strip is spaced a distance sufficient from the outlet adjacent thereto to receive an oversized plug or adapter without interfering with the receipt of a standard-sized pronged plug by the adjacent outlet.

Each outlet fo the electrical strip of the present invention is preferably adapted for receipt of a three-pronged plug, the outlet including two elongated prong-receiving apertures and a ground prong-receiving aperture. Preferably, the elongated apertures of the outlet are arranged with their longitudinal axes perpendicular to the longitudinal axis of the housing of the outlet strip.

The internal wiring of the electrical outlet strip of the present invention includes a circuit breaker built directly into the outlet strip housing and connected in series with the "hot" feed wire providing alternating current to the outlets of the strip.

The electrical outlet strip of the present invention is also provided with improved means for removably mounting the strip to a wall, floor or other surface. Mounting means generally comprises a U-shaped outlet strip cradle for retaining the outlet strip which can be attached to any desired surface. Preferably, the cradle includes a cord channel with cord guide grooves to prevent cord tangle.

BRIEF DESCRIPTION OF THE DRAWINGS

FIG. 3 is an elevational view of a preferred embodiment of the internal wiring of the outlet strip of the invention.

DETAILED DESCRIPTION OF THE PREFERRED EMBODIMENTS

Figure 1:
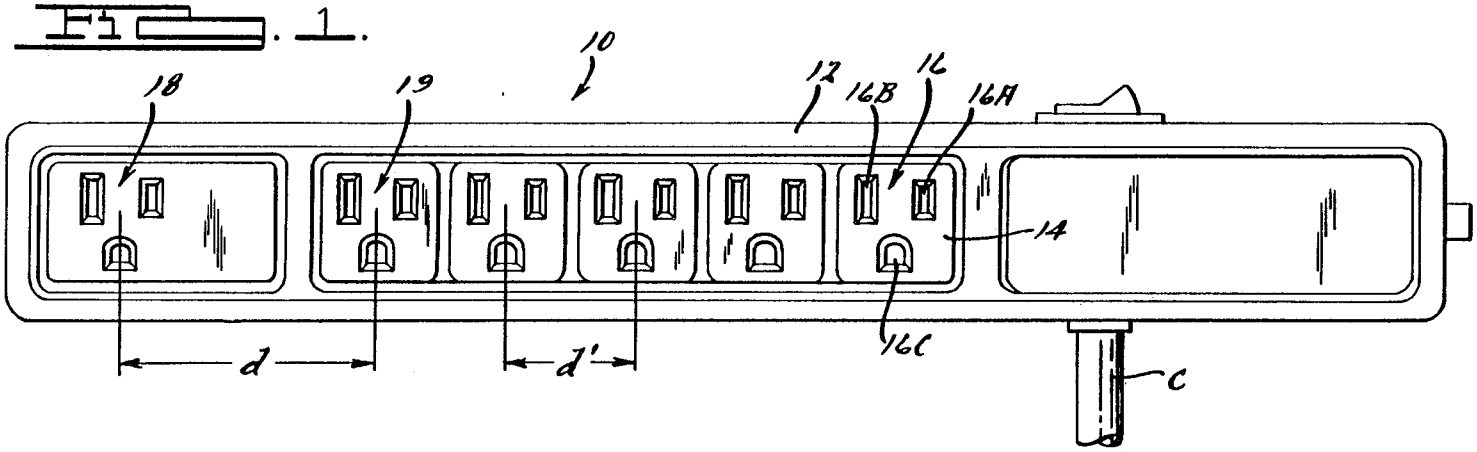
FIG. 1 is a top view of a preferred embodiment of the electrical outlet strip of the present invention.

Referring now to FIG. 1, an electrical outlet strip of the present invention is shown and indicated generally by the numeral 10. Outlet strip 10 generally comprises an elongate housing 12 encasing a plurality of socket bodies 14 serially arranged therewithin. As shown in FIG. 1, extending from the housing 12 is outlet strip cord C which connects the internal wiring of outlet strip 10 to an electrical source, e.g. a wall or floor electrical outlet. Housing 12 may be made of plastic, metal or any other suitably rigid material. Preferably, housing 12 is constructed of moldable plastic, such as ABS or polystyrene.

As shown in FIG. 1, each socket body 14 provides an individual electrical outlet 16 having two elongated apertures 16A, 16B adapted for the receipt of a pronged plug having prongs of different polarities. Each outlet also preferably includes an aperture 16C adapted for receipt of a ground prong of the plug. Preferably, the longitudinal axes of elongated apertures 16A, 16B are arranged so that they are perpendicular to the longitudinal axis of housing 12. However, the longitudinal axes of the elongated apertures may instead be arranged parallel to the longitudinal axis of the housing, or a combination of perpendicular and parallel arrangements may be employed.

Referring again to FIG. 1, a terminal outlet 18 of the outlet strip 10 of the invention is spaced from its adjacent outlet a center-to-center distance d, distance d being sufficient to allow receipt of an oversized plug or adapter by terminal outlet 18 without interfering with the use of adjacent outlet 19. The remaining outlets are evenly spaced from one another a distance d', which is less than distance d between terminal outlet 18 and adjacent outlet 19. Oversized plugs and adapters are hereinafter collectively referred to as "adapters", and include transformers used for computer hook-ups or modems, for converting current, for recharging batteries, for supplying electrical current to direct current-powered devices and the like. Suitable distances d between terminal and adjacent outlet are, for example, from about 1.8 to about 2.6 inches. Preferably, distance d is about 2.2 inches. Suitable distances d' between the remaining evenly-spaced outlets are, for example, from about 0.9 to about 1.3 inches. Preferably, distance d' is about 1.1 inches.

Figure 2:
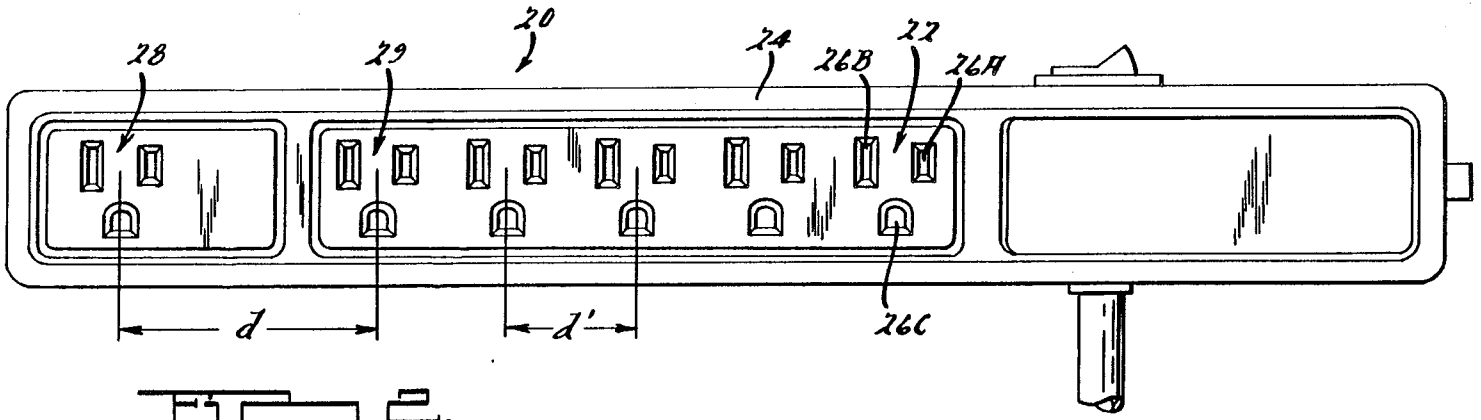
FIG. 2 is a top view of another preferred embodiment of the electrical outlet strip of the present invention.
Figure 2:
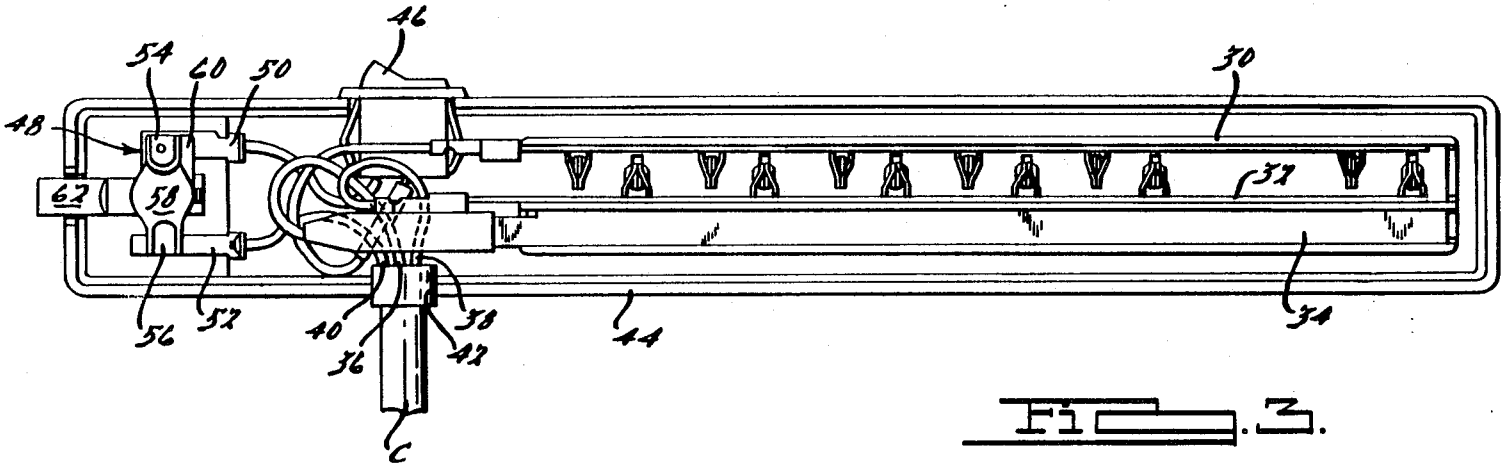

Referring now to FIG. 2, another preferred embodiment of the electrical outlet strip of the present invention is shown and denoted by the numeral 20. As shown in FIG. 2, outlet strip 20 comprises a serially-arranged strip of outlets 22 within a housing 24. Although not shown this way in FIG. 2, housing 24 may be molded or stamped to give the appearance of individual socket bodies encased in a housing. Alternatively, the housing surface may have generally planar surface portions between outlets as shown in FIG. 2, to give the housing an attractive appearance.

Referring again to FIG. 2, each outlet 22 of outlet strip 20 includes a pair of elongated apertures 26A, 26B and, preferably, a ground plug aperture 26C adapted for receipt of a three-pronged plug. As in the preferred embodiment depicted in FIG. 1, a terminal outlet 28 of outlet strip 20 of FIG. 3 is spaced from its adjacent outlet 29 a center-to-center distance d greater than a distance d' between the remaining evenly-spaced outlets. As discussed above with respect to the preferred embodiment of FIG. 1, distance d is sufficient to allow receipt of an adapter by terminal outlet 28 without interfering with the use of the outlet 29 adjacent thereto. Suitable distances d and d' are the same as those given for outlet strip 10 shown in FIG. 1.

It should be appreciated that, although the outlet strips of FIGS. 1 and 2 are illustrated as having six outlets, any number of outlets can be employed in the practice of the present invention. The number of outlets in an electrical outlet strip of the invention will be limited solely by the length of the housing, the electrical load the strip is designed to handle, customer demand and other practical considerations. It should also be appreciated that, although only one terminal outlet in the embodiments depicted in the Figures is shown being spaced a distance d from its adjacent outlet, the terminal outlets at both ends of the outlet strip or any two or more outlets of the outlet strip of the invention can be spaced a distance d from adjacent outlets to accommodate receipt of an oversized plug or adapter according to the principles of the invention.

Referring now to FIG. 3, an elevational view of a preferred embodiment of the internal wiring of the outlet strip of the present invention is shown. The internal wiring of the outlet strip generally comprises three electrically conductive bus bars 30, 32, 34, each of which provides the internal side walls of its respective outlet aperture. As shown in FIG. 3, the bus bars are constructed and arranged so that each prong of a pronged plug received by an outlet of the outlet strip will make good contact with its respective bus bar.

Referring again to FIG. 3, one end of each bus bar is connected in series with a respective feed wire; ground wire 36, common wire 38, or "hot" wire 40 which feeds electricity to the outlets. As shown in FIG. 3, the feed wires are bundled together into an insulated outlet strip cord C which passes through cord aperture 42 in housing wall 44 and terminates in a three-pronged cord plug (not shown) for connecting the outlet strip to its electrical source. Although in FIG. 3, outlet strip cord C is shown emerging from cord aperture 42 in a side wall of the housing, the exact position of cord aperture 42 in housing 44 is not critical.

As shown in FIG. 3, switch 46 is connected in series with "hot" feed wire 40 for turning off the electrical current supplied by the outlet strip. Switch 46 is also connected in series with a built-in circuit breaker 48. The housing and mounting support of circuit breaker 48 of the present invention is molded unitary with the housing of the outlet strip. The functioning parts of circuit breaker 48, however, are generally standard components.

As shown in FIG. 2, circuit breaker 48 comprises connectors 50, 52 which connect circuit breaker 48 in series with switch 46 and hot wire 40. The ends of connectors distal from their point of attachment to hot wire 40 provide contact points 54, 56 which are bridged by a bimetal strip 58. Upon overheating, bimetal strip 58 differentially expands, allowing insulator 60 of spring-loaded reset button 62 to slip between contact point 54 and bimetal strip 58 to break the circuit. Depression of reset button 62 will displace insulator 60 and allow bimetal strip and contact point 54 to re-establish contact and restore the circuit.

Figure 4:
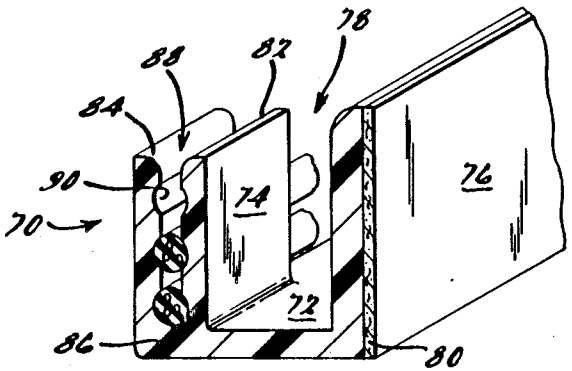
FIG. 4 is a perspective view of a preferred embodiment of an electrical outlet strip cradle for removably mounting an electrical outlet strip to a surface.

Turning now to FIG. 4, the electrical outlet strip of the present invention is further provided with improved mounting means for removably mounting the outlet strip to a desired surface. As shown in FIG. 4, mounting means of the present invention generally comprises an outlet strip cradle denoted generally by the numeral 70. Cradle 70 is generally U-shaped in cross-section with base 72 and side walls 74 and 76 integrally molded together to define a channel 78.

As shown in FIG. 4, wall 76 of cradle 70 further comprises an adhesive pad 80 which provides attachment means for attaching the cradle to the desired surface. Suitable attachment means include, for example, any suitable adhesive tape, backing or pad, which will minimize any damage to the surface adhesive tape, backing or pad, which will minimize any damage to the surface to which the cradle is attached. Alternately, any suitable fastener can be employed through an aperture (not shown) in cradle 70.

Referring again to FIG. 4, wall 74 of cradle 70 preferably comprises an inner wall 82, and an outer wall 84 jointed by web 86 to define a cord channel 88. The adjacent surfaces of inner and outer walls also preferably include one or more cord guide grooves 90 through which cords of plugs received by the outlet strip can be threaded to eliminate loose cords or cord tangle.

In use, an electrical outlet strip is placed into strip channel 78 of cradle 70 which holds the outlet strip in place. If desired, more than one cradle 70 can be used to hold one outlet strip. As is clear from the embodiment depicted in FIG. 4, an outlet strip can be easily removed from and replaced into cradle 70. Cradle 70 of the present invention can be constructed of any suitably rigid material which can be shaped into the desired form. Suitable materials include plastics, rubber and metal, and, more preferably, moldable plastics.

It should be appreciated that a latitude of modification, change and substitution is intended in the foregoing disclosure and, in certain instances, some features of the invention will by employed without a corresponding use of other features. Accordingly, it is appropriate that the appended claims be construed broadly and in a manner consistent with the spirit and the scope of the invention herein.

What is claimed is:

1. An electrical outlet strip comprising:

an elongated insulating housing and a plurality of outlets arrayed in a substantially flat serial strip within said housing, each of said outlets including a plurality of apertures adapted for receipt of a pronged plug, said plurality of outlets further comprising an adapter outlet and remaining outlets, wherein said remaining outlets are evenly spaced and wherein said adapter outlet is spaced from the remaining outlet adjacent thereto a distance greater than the distance between said remaining evenly-spaced outlets and said distance between said adapter outlet and a said remaining outlet adjacent thereto is sufficient to permit receipt of an adapter of a configuration which if received by one of said evenly spaced remaining outlets would interfere with the receipt of a standard-sized pronged plug by a said evenly-spaced remaining outlet adjacent thereto, without interfering with the receipt of a standard-sized pronged plug by the remaining outlet adjacent to remaining said adapter outlet.

2. The electrical outlet strip of claim 1, wherein said apertures include two elongated apertures and a third aperture adapted for receipt of a ground prong of a three-pronged plug, and the longitudinal axes of said elongated apertures are perpendicular to the longitudinal axis of said elongated housing.

3. The electrical outlet strip of claim 2, wherein said outlet strip comprises internal wiring residing in said elongated insulating housing, said wiring comprising a bus bar, a feed wire for providing alternating current to said outlets of said strip connected in series with said bus bar, and a circuit breaker connected in series with said feed wire, wherein said circuit breaker housing is unitary with said housing.

4. The electrical outlet strip of claim 2, further comprising a U-shaped cradle adapted for removable receipt of said outlet strip, said cradle having a base portion, a support portion integral therewith, and a retaining portion integral with said support portion, said base portion having attachment means for attaching said cradle to a surface.

5. The electrical outlet strip of claim 4, wherein said retaining portion of said cradle includes a cord channel for retaining an electrical cord and said attachment means comprises an adhesive pad.

6. An electrical outlet strip comprising:

an elongated housing containing a plurality of serially arranged outlets having apertures adapted for receipt of pronged plugs, said plurality of outlets comprising a terminal outlet and remaining outlets, wherein said terminal outlet is in the same plane and spaced from a remaining outlet adjacent thereto a distance d, said remaining said outlets are spaced from one another a distance d', and d is greater than d'.

7. The electrical outlet strip of claim 6, wherein d is a distance sufficient to allow said terminal outlet to receive an adapter without interfering with the use of said adjacent remaining outlet.

8. The electrical outlet strip of claim 7, wherein d is in the range of from about 1.8 to about 2.6 inches, and d' is in the range of from about 0.9 to about 1.3 inches.

9. The electrical outlet strip of claim 8, wherein d is about 2.2 inches, and d' is about 1.1 inches.

10. In combination with an electrical outlet strip having a plurality of outlets mounting means for removably mounting said electrical outlet strip on a surface, said mounting means comprising a U-shaped cradle having a base and side walls integral with said base, said base and side walls defining a strip channel adapted for nesting receipt of the electrical outlet strip, wherein one of said side walls of said cradle includes attachment means for attaching said cradle to said surface.

11. Mounting means of claim 10, wherein one of said side walls of said cradle comprises an inner wall, a web integral therewith, and an outer wall integral with said web, said inner and outer walls and said web defining a cord channel.

12. Mounting means of claim 11, wherein the adjacent surfaces of said inner and outer walls further define a guide groove for a cord passing through said cord channel.

13. Mounting means of claim 11, wherein said attachment means comprises an adhesive backing.

14. An electrical outlet strip comprising:

an elongated insulating housing containing a plurality of outlets arranged in a substantially flat serial array, said outlets having elongated apertures adapted for receipt of spaced pronged plugs, wherein the longitudinal axes of said elongated apertures are perpendicular to the longitudinal axis of said elongate housing, said outlets comprising a terminal outlet and non-terminal outlets, wherein said terminal outlet of said strip is spaced from a non-terminal outlet adjacent thereto a distance d sufficient to receive an adapter without interfering with the receipt of a pronged plug by said adjacent non-terminal outlet, and the non-terminal outlets are evenly spaced from one another a distance d', wherein d is greater than d'and d is in the range of from about 1.8 to about 2.6 inches.

15. The electrical outlet spring of claim 14 further comprising a circuit breaker housing unitary with said elongated insulating housing.

16. The electrical outlet strip of claim 14 further comprising mounting means for removably mounting said strip to a surface, said mounting means comprising a U-shaped holder adapted for receipt of the electrical outlet strip, said holder including a cord channel adapted for passage of an electrical cord therethrough.

* * * * *

UNITED STATES PATENT AND TRADEMARK OFFICE

CERTIFICATE OF CORRECTION

PATENT NO. : 4,867,701

DATED : September 19, 1989

INVENTOR(S) : Richard K. Wiand

It is certified that error appears in the above-identified patent and that said Letters Patent is hereby corrected as shown below:

U.S. Patent Document: "4,133,349" should be --4,113,334--.

Column 1, line 18, "outlets" should be --outlet--.

Column 1, line 51, "fo" should be --of--.

Column 4, lines 25-27, after "surface" delete --adhesive tape, backing or pad, which will minimize any damage to the surface--.

Column 4, line 50, "by" should be --be--.

Column 5, line 7, before "remaining" insert --said--.

Column 5, line 8, after "to" delete --remaining--.

Column 5, line 44, after "remaining" insert --said--.

Column 5, line 45, after "remaining" delete --said-- 2nd occurrence.

Column 6, line 43, "spring" should be --strip--.

Signed and Sealed this

Twenty-first Day of January, 1992

*Attest:*

HARRY F. MANBECK, JR.

*Attesting Officer*

*Commissioner of Patents and Trademarks*